US007911461B2

(12) United States Patent
Chiang

(10) Patent No.: US 7,911,461 B2
(45) Date of Patent: Mar. 22, 2011

(54) CURRENT DISTRIBUTOR

(75) Inventor: Yung-Hsin Chiang, Hsindian (TW)

(73) Assignee: ADDtek Corp., Songshan District, Taipei (TW)

( * ) Notice: Subject to any disclaimer, the term of this patent is extended or adjusted under 35 U.S.C. 154(b) by 423 days.

(21) Appl. No.: 12/098,944

(22) Filed: Apr. 7, 2008

(65) Prior Publication Data

US 2009/0108773 A1 Apr. 30, 2009

(51) Int. Cl.
*G09G 5/00* (2006.01)

(52) U.S. Cl. ..... 345/211; 345/82; 345/84; 345/90; 345/204

(58) Field of Classification Search ..... 345/82, 345/84, 90, 92, 102, 104, 204, 211, 212, 345/214; 315/185 S, 247, 224, 291–326
See application file for complete search history.

(56) References Cited

U.S. PATENT DOCUMENTS 7,847,783 B2 * 12/2010 Liu et al. ..... 345/102

* cited by examiner

*Primary Examiner* — Tuyet Thi Vo
(74) *Attorney, Agent, or Firm* — Winston Hsu; Scott Margo

(57) ABSTRACT

A current distributor that simplifies the architecture and reduces the connecting wires. According to the invention, current distributor can be utilized for distributing the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a plurality of first clamp circuitries, a second clamp circuitry and a plurality of first transistors. The first resistor has a first end and a second end. The first end is coupled to the supply pin. Each of the plurality of first clamp circuitries has a first terminal and a second terminal. Each of the first terminal of the first clamp circuitries is coupled to the second end of the first resistor. Each of the second terminal of the first clamp circuitries is coupled to the first current pin. The second clamp circuitry has a first terminal and a second terminal. The second terminal of the second clamp circuitry is coupled to the second end of the first resistor. The plurality of first transistors has a first terminal, a second terminal and a gate. The first terminal is coupled to the first current pin. The gate is coupled to the cathode of the second diode. The second terminal is coupled to the total current pin.

5 Claims, 4 Drawing Sheets

CURRENT DISTRIBUTOR

BACKGROUND OF THE INVENTION

1. Field of the Invention

The present invention relates generally to a current distribution technique, and more particularly to a current distributor that equally shares the total current.

2. Description of Prior Art

Current techniques available in the conventional current paths having a number of light-emitting diodes provide no notion of how to solve the problem of dividing the current flowing through the current paths evenly.

To copy current between a plurality of current paths, some presently available techniques adopt a current mirror. Conventional current mirror has been developed for providing a constant current. The current mirror has a master current path for providing primary control over the other slave current paths. Each current path comprises a similar transistor.

Referring to FIG. 1, a schematic diagram of a conventional current mirror with a plurality of current channels is shown. Each current channel comprises a number of light-emitting diodes. The transistors are connected in series to the rows of light-emitting diodes, respectively. If transistor is operated in the saturation region, the current into the drain node is ideally identical.

However, when current paths have dissimilar impedances, the drain-to-source voltage across one transistor is not equal to the drain-to-source voltage across other transistor. If the drain-to-source voltage across transistor of any of the slave current paths is smaller than the drain-to-source voltage across transistor of the master current paths, this transistor of the slave current path is possibly driven into the linear region. Thus, the current flowing through the rows of light-emitting diodes will not divide evenly.

Presently available rows of light-emitting diodes have the problems of dissimilar impedances, thereby inducing the possibility of driven transistor into the linear region and current mismatching between the rows of light-emitting diodes.

SUMMARY OF THE INVENTION

The present invention provides a current distribution technique to resolve the foregoing problems faced by the conventional current distributor. The present invention also has the advantage to avoid current mismatching. Moreover, the present invention also provides an open circuit protection for the current distributor which is non-existent in the present art.

An object of the present invention is to provide a current distributor, wherein the architecture just needs two wires. The current distributor can be located in a backlight module of a LCD.

In accordance with an aspect of the present invention, a current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a plurality of first diodes, a second diode and a plurality of first transistors. The first resistor has a first end and a second end. The first end is coupled to the supply pin. Each of the plurality of first diodes has a first electrode and a second electrode. Each of the first electrode is coupled to the second end of the first resistor. Each of the second electrode is coupled to the first current pin. The second diode has a cathode and an anode. The anode is coupled to the second end of the first resistor. The plurality of first transistors has a first terminal, a second terminal and a gate. The first terminal is coupled to the first current pin. The gate is coupled to the cathode of the second diode. The second terminal is coupled to the total current pin.

In the preferred embodiment of the invention, the first electrode of each of the first diode is an anode. The second electrode of each of the first diode is a cathode. The first terminal of each of the first transistor is a drain. The second terminal of each of the first transistor is a source.

In accordance with another aspect of the present invention, another current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a second resistor, a plurality of first clamp circuitries, a comparator, a second clamp circuitry and a plurality of first transistors. The first resistor has a first end and a second end. The first end is coupled to the supply pin. The second resistor has a third end and a forth end. The third end is coupled to the supply pin. The plurality of first clamp circuitries is coupled to the second end of the first resistor and the first current pin. The comparator has first and second input terminals and an output terminal. The first input terminal is coupled to the second end of the first resistor. The second input terminal is coupled to the forth end of the second resistor. The second clamp circuitry is coupled between the forth end of the second resistor and the total current pin. The plurality of first transistors has a first terminal, a second terminal and a gate. The first terminal is coupled to the first current pin. The gate is coupled to the output terminal of the comparator. The second terminal is coupled to the total current pin.

In the preferred embodiment of the invention, the plurality of first clamp circuitries includes a forward diode. The first terminal of each of the first transistor is a drain. The second terminal of each of the first transistor is a source. The comparator is an error amplifier. The second clamp circuitry includes a forward diode.

In accordance with a further aspect of the present invention, a further current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a plurality of first clamp circuitries, a second clamp circuitry, a second resistor and a plurality of first transistors. The first resistor has a first end and a second end. The first end is coupled to the supply pin. The plurality of first clamp circuitries is coupled to the second end of the first resistor and the first current pin. The second clamp circuitry has a third terminal and a forth terminal. The third terminal is coupled to the second end of the first resistor. The second resistor has a third end and a forth end. The third end is coupled to the forth terminal of the second clamp circuitry. The plurality of first transistors has a first terminal, a second terminal and a gate. The first terminal is coupled to the first current pin. The gate is coupled to the forth terminal of the second clamp circuitry. The second terminal is coupled to the total current pin.

In the preferred embodiment of the invention, the first clamp circuitry includes a Zener diode. The first clamp circuitry includes a third resistor. The Zener diode has a first electrode and a second electrode. The first electrode is an anode, and the second electrode is a cathode. The anode is the first terminal of the first clamp circuitry. The second clamp circuitry includes a diode. The diode has a third electrode and a forth electrode. The third electrode is an anode, and the forth electrode is a cathode. The third electrode is a third terminal of the second clamp circuitry, and the forth electrode is a forth terminal of the second clamp circuitry. The first terminal of each of the first transistor is a drain, and the second terminal of each of the first transistor is a source.

The present invention may best be understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purpose of illustration and description only. It is not intended to be exhaustive or to be limited to the precise form disclosed.

The present invention describes a new standardized interface between Backlight of a LCD and a Control board that will minimize the number of the wires to only two wires. Accordingly, the problem faced by the prior arts can be solved completely. The presently described current distributor, thus, serves demands much more adequately.

According to the preferred embodiment of the present invention, a current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a plurality of first diodes, a second diode and a plurality of first transistors. The first resistor has a first end and a second end. The first end is coupled to the supply pin. Each of the plurality of first diodes has a first electrode and a second electrode. Each of the first electrode is coupled to the second end of the first resistor. Each of the second electrode is coupled to the first current pin. The second diode has a cathode and an anode. The anode is coupled to the second end of the first resistor. The plurality of first transistors has a first terminal, a second terminal and a gate. The first terminal is coupled to the first current pin. The gate is coupled to the cathode of the second diode. The second terminal is coupled to the total current pin.

The first electrode of each of the first diode is an anode. The second electrode of each of the first diode is a cathode. The first terminal of each of the first transistor is a drain. The second terminal of each of the first transistor is a source.

Figure 1:
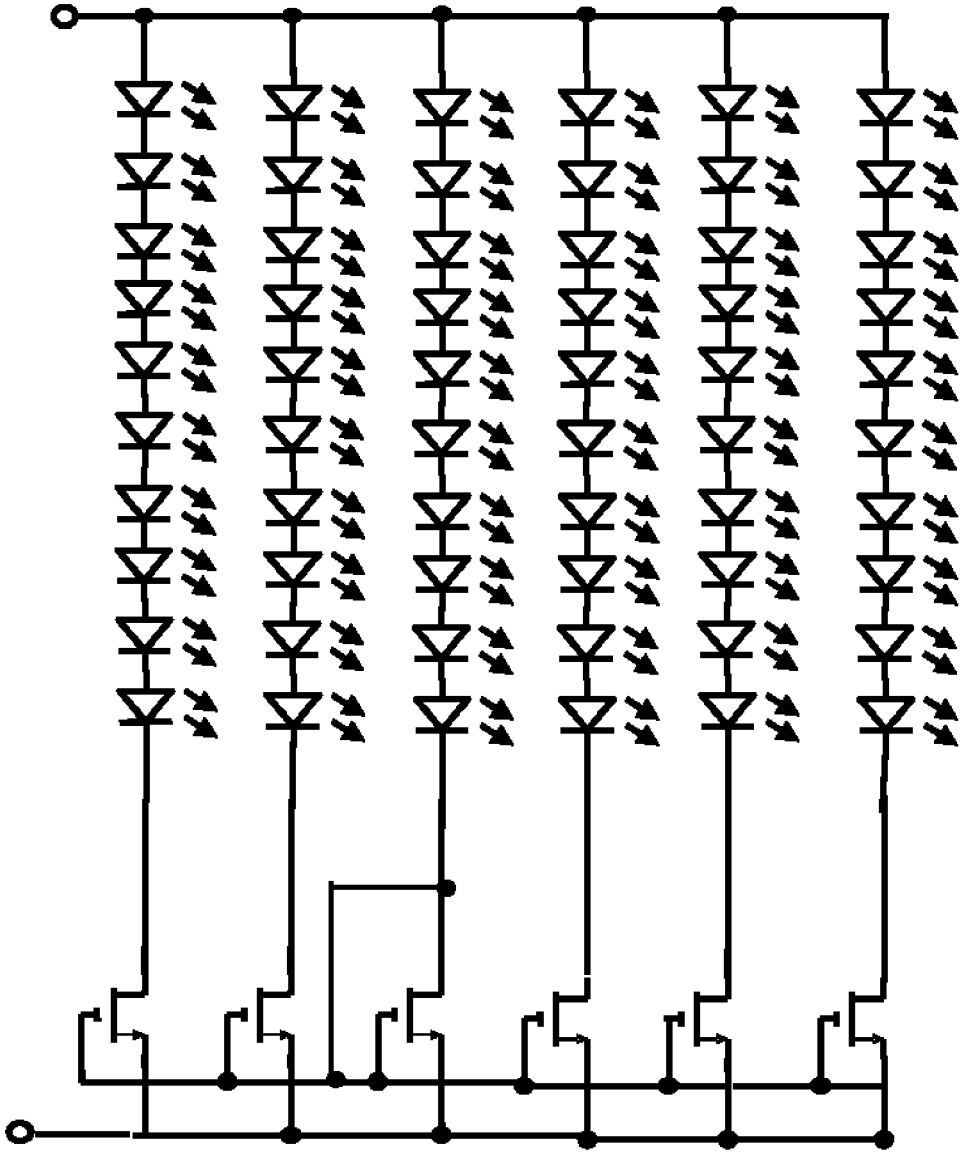
FIG. 1 shows a schematic diagram of a conventional current distributor with a plurality of current channels.
Figure 2:
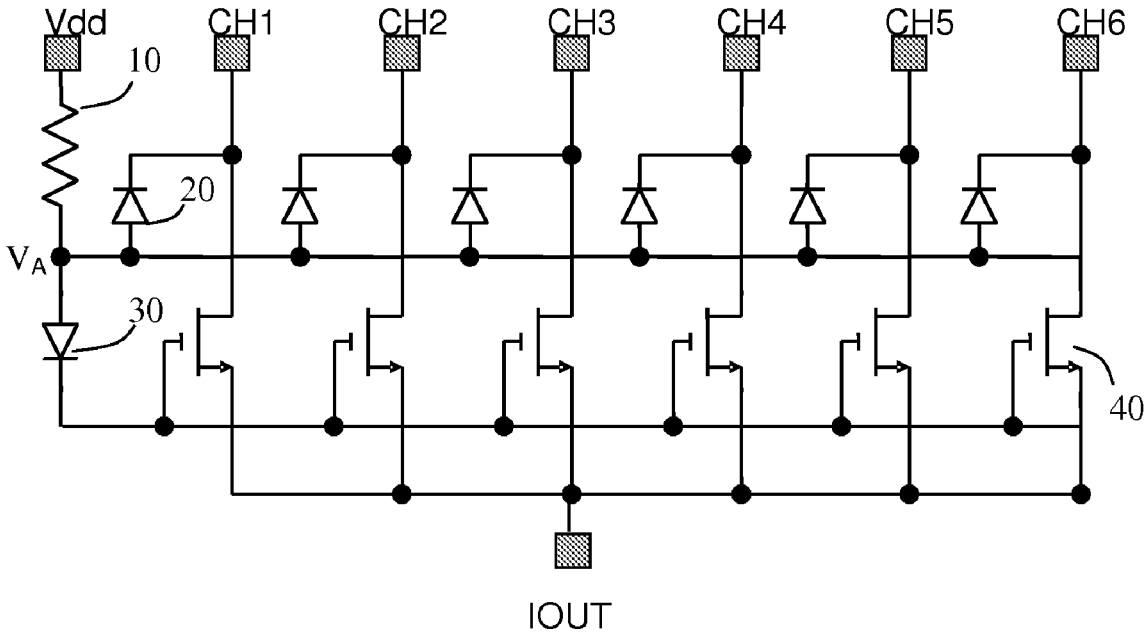
FIG. 2 shows a schematic diagram of a current distributor of the first preferred embodiment according to the present invention.

Referring to FIG. 2, a schematic diagram of a current distributor of the first preferred embodiment according to the present invention is shown. The current distributor of the first preferred embodiment distributes the current evenly through a plurality of rows of light-emitting diodes. Each respectively is coupled between a supply pin Vdd and a first current pin CH1~CH6. The first current pin CH1~CH6 is coupled to the current distributor. The current distributor is coupled to a total current pin Iout.

The current distributor comprises a first resistor 10, a plurality of first diodes 20, a second diode 30 and a plurality of first transistors 40. The first resistor 10 has a first end and a second end. The first end is coupled to the supply pin Vdd. Each of the plurality of first diodes 20 has a first electrode and a second electrode. Each of the first electrode is coupled to the second end of the first resistor 10. Each of the second electrode is coupled to the first current pin CH1~CH6. The first electrode of each of the first diode 20 is an anode. The second electrode of each of the first diode 20 is a cathode.

The second diode 30 has a cathode and an anode. The anode is coupled to the second end of the first resistor 10. The plurality of first transistors 40 has a first terminal, a second terminal and a gate. The first terminal is coupled to the first current pin CH1~CH6. The gate is coupled to the cathode of the second diode 30. The second terminal is coupled to the total current pin Iout. The first terminal of each of the first transistor 40 is a drain. The second terminal of each of the first transistor 40 is a source.

The current flows in the forward diode direction and generates a drop-out voltage. The minimum drain-to-source voltage of the first transistor 40 of one current path is sensed and the value is equal to the VA minus the forward voltage of the first diode 20. While the gate-to-source voltage VGS is VA minus the forward voltage of the second diode 30 and the first diode 20 is similar to the second diode 30, the gate-to-source voltage VGS is equal to the minimum drain-to-source voltage of the first transistor 40. Since the first transistor 40 with minimum drain-to-source voltage is operated in the saturation region, all of the first transistors 40 are operated in the saturation region. Hence, the current flowing through the rows of light-emitting diodes can divide evenly. Also, the current distributor can be produced with a low cost.

According to the preferred embodiment of the present invention, there is another current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a second resistor, a plurality of first clamp circuitries, a comparator, a second clamp circuitry and a plurality of first transistors. The first resistor has a first end and a second end. The first end is coupled to the supply pin. The second resistor has a third end and a forth end. The third end is coupled to the supply pin. The plurality of first clamp circuitries is coupled to the second end of the first resistor and the first current pin. The comparator has first and second input terminals and an output terminal. The first input terminal is coupled to the second end of the first resistor. The second input terminal is coupled to the forth end of the second resistor. The second clamp circuitry is coupled between the forth end of the second resistor and the total current pin. The plurality of first transistors has a first terminal, a second terminal and a gate. The first terminal is coupled to the first current pin. The gate is coupled to the output terminal of the comparator. The second terminal is coupled to the total current pin.

The plurality of first clamp circuitries includes a forward diode. The first terminal of each of the first transistor is a drain. The second terminal of each of the first transistor is a source. The comparator is an error amplifier. The second clamp circuitry includes a forward diode.

Figure 3:
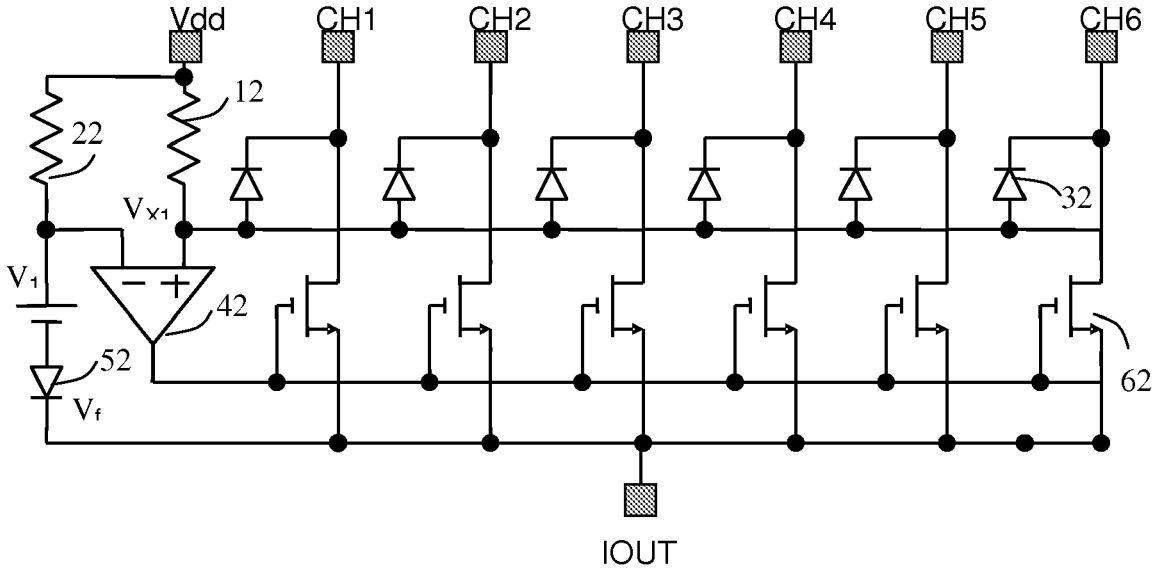
FIG. 3 shows a schematic diagram of a current distributor of the second preferred embodiment according to the present invention.

Referring to FIG. 3, a schematic diagram of a current distributor of the second preferred embodiment according to the present invention is shown. The current distributor of the second preferred embodiment distributes the current evenly through a plurality of rows of light-emitting diodes. Each respectively is coupled between a supply pin Vdd and a first current pin CH1~CH6. The first current pin CH1~CH6 is coupled to the current distributor. The current distributor is coupled to a total current pin Iout.

The current distributor with a low drop-out comprises a first resistor 12, a second resistor 22, a plurality of first clamp circuitries, a comparator 42, a second clamp circuitry 52 and a plurality of first transistors 62. The first resistor 12 has a first end and a second end. The first end is coupled to the supply pin Vdd. The second resistor 22 has a third end and a forth end. The third end is coupled to the supply pin Vdd.

As shown in this figure, each of the plurality of first clamp circuitries includes a first diode 32. The plurality of first diodes 32 has a first electrode and a second electrode. Each of the first electrode is coupled to the second end of the first resistor 12. Each of the second electrode is coupled to the first current pin CH1~CH6. The first electrode of each of the first diode 32 is an anode. The second electrode of each of the first diode 32 is a cathode. Alternatively, the plurality of first clamp circuitries may otherwise include a zener diode and a resistor.

The comparator 42 has first and second input terminals and an output terminal. The first input terminal is coupled to the second end of the first resistor 12. The second input terminal is coupled to the forth end of the second resistor 22. The second clamp circuitry 52 includes a forward diode. The second clamp circuitry 52 is coupled between the forth end of the second resistor 22 and the total current pin Iout.

The plurality of first transistors 62 has a first terminal, a second terminal and a gate. The first terminal is coupled to the first current pin CH1~CH6. The gate is coupled to the output terminal of the comparator 42. The second terminal is coupled to the total current pin Iout. The first terminal of each of the first transistor 62 is a drain. The second terminal of each of the first transistor 62 is a source.

The comparator 42 is an error amplifier. The error amplifier compares the reference voltage VX1 with the voltage V1+Vf and then outputs the difference between the two voltages. The error signal controls the gate-to-source voltage VGS of the plurality of first transistors 62. The minimum drain-to-source voltage of transistor 62 of one current path is sensed and clamped to the voltage V1. All of the transistors 62 are operated in the saturation region. Hence, the current flowing through the rows of light-emitting diodes can divide evenly.

According to the preferred embodiment of the present invention, there is a further current distributor distributes the current evenly through a plurality of rows of light-emitting diodes. Each respectively is coupled between a supply pin and a first current pin. The first current pin is coupled to the current distributor. The current distributor is coupled to a total current pin. The current distributor comprises a first resistor, a plurality of first clamp circuitries, a second clamp circuitry, a second resistor and a plurality of first transistors. The first resistor has a first end and a second end. The first end is coupled to the supply pin. The plurality of first clamp circuitries has a first terminal and a second terminal. Each of the first terminal is coupled to the second end of the first resistor. Each of the second terminal is coupled to the first current pin. The second clamp circuitry has a third terminal and a forth terminal. The third terminal is coupled to the second end of the first resistor. The second resistor has a third end and a forth end. The third end is coupled to the forth terminal of the second clamp circuitry. The plurality of first transistors has a first terminal, a second terminal and a gate. The first terminal is coupled to the first current pin. The gate is coupled to the forth terminal of the second clamp circuitry. The second terminal is coupled to the total current pin.

The first clamp circuitry includes a Zener diode. The first clamp circuitry includes a third resistor. The Zener diode has a first electrode and a second electrode. The first electrode is an anode, and the second electrode is a cathode. The anode is the first terminal of the first clamp circuitry. The second clamp circuitry includes a diode. The diode has a third electrode and a forth electrode. The third electrode is an anode, and the forth electrode is a cathode. The third electrode is a third terminal of the second clamp circuitry, and the forth electrode is a forth terminal of the second clamp circuitry. The first terminal of each of the first transistor is a drain, and the second terminal of each of the first transistor is a source.

Figure 4:
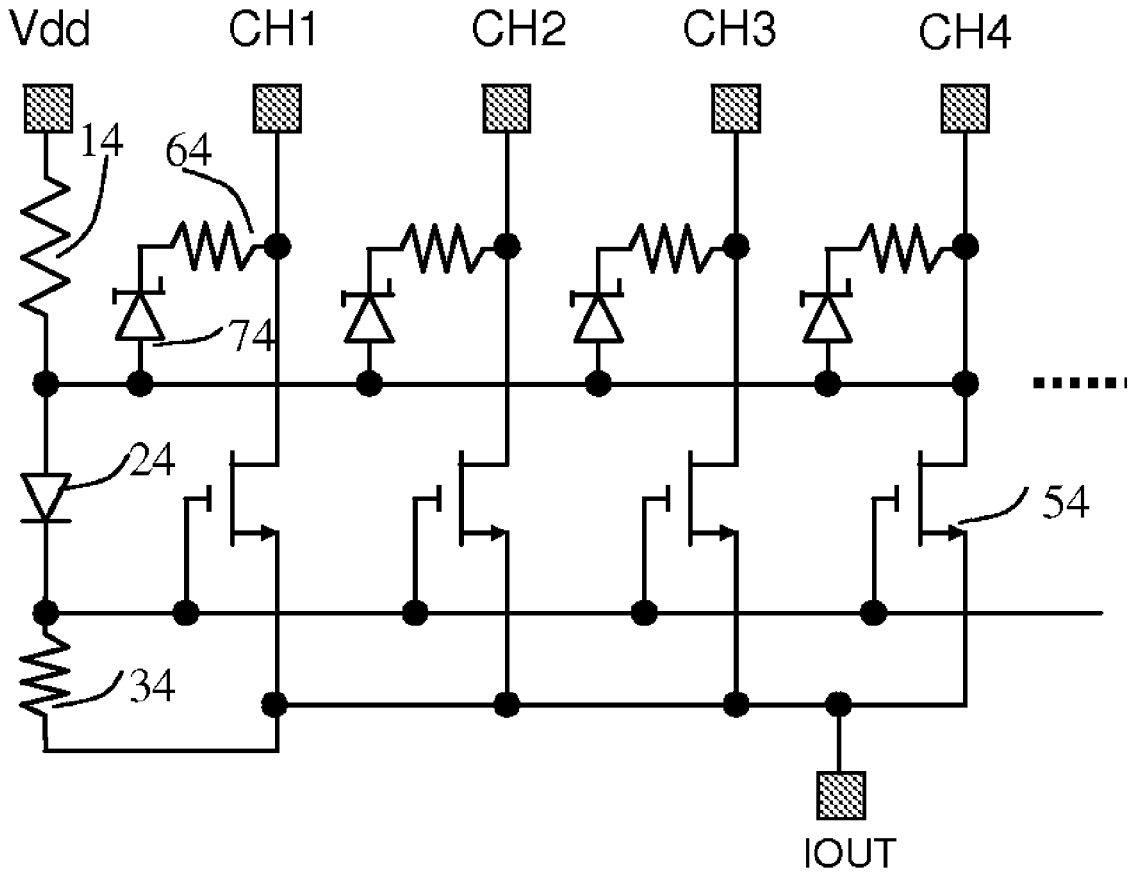
FIG. 4 shows a schematic diagram of a current distributor of the third preferred embodiment according to the present invention.

Referring to FIG. 4, a schematic diagram of a current distributor of the third preferred embodiment according to the present invention is shown. The current distributor of the third preferred embodiment distributes the current evenly through a plurality of rows of light-emitting diodes. Each respectively is coupled between a supply pin Vdd and a first current pin CH1~CH4. The first current pin CH1~CH4 is coupled to the current distributor. The current distributor is coupled to a total current pin Iout.

The current distributor comprises a first resistor 14, a plurality of first clamp circuitries, a second clamp circuitry 24, a second resistor 34 and a plurality of first transistors 54. The first resistor 14 has a first end and a second end. The first end is coupled to the supply pin Vdd. The plurality of first clamp circuitries has a first terminal and a second terminal. Each of the first terminal is coupled to the second end of the first resistor. Each of the second terminal is coupled to the first current pin CH1~CH4.

As shown in this figure, the first clamp circuitry includes a Zener diode 74 and a third resistor 64. The Zener diode 74 has a first electrode and a second electrode. The first electrode is an anode, and the second electrode is a cathode. The anode is the first terminal of the first clamp circuitry. Alternatively, the Zener diode 74 may be replaced by a simple diode. If this is the case, the simple diode has a first electrode and a second electrode. The first electrode is an anode, and the second electrode is a cathode. The anode is the first terminal of the first clamp circuitry. Moreover, the first clamp circuitry may further include a plurality of diodes connected in series in a certain polarity. The simple diode and the third resistor 64 may coupled to the diodes in parallel.

The second clamp circuitry 24 has a third terminal and a forth terminal. The third terminal is coupled to the second end of the first resistor 14. The second resistor 34 has a third end and a forth end. The third end is coupled to the forth terminal of the second clamp circuitry 24. The second clamp 24 circuitry is a diode. The diode has a third electrode and a forth electrode. The third electrode is an anode, and the forth electrode is a cathode. The third electrode is a third terminal of the second clamp circuitry 24, and the forth electrode is a forth terminal of the second clamp circuitry 24. The plurality of first transistors 54 has a first terminal, a second terminal and a gate. The first terminal is coupled to the first current pin CH1~CH4. The gate is coupled to the forth terminal of the second clamp circuitry 24. The second terminal is coupled to the total current pin Iout. The first terminal of each of the first transistor 54 is a drain, and the second terminal of each of the first transistor is a source. When a channel is open-circuited, the drain-to-source voltage will be decreased, and the gate voltage of all of the first transistors 54 will be reduced. The drop-out voltage of all other channels will be increased at the same time. As soon as the highest drop-out voltage of one of the channels is increased up to voltage across the zener diode 74 and the third resistor 64, the Zener diode 74 of the channel may breakdown and conducts current in the reverse direction. The current flows through open-circuited channel to the total current pin Iout.

A voltage will be developed because of Rds-on (turn-on impedance from drain to source) of the transistor 54 and the third resistor 64. The voltage will feed to gate of the transistor 54 and turn on all of the first transistors 54 again. Thus, the current distributor may distribute the current evenly through other channels.

The present invention equally shares the total current. The present invention also eliminates risks of shutdown caused by an open-circuited channel. Hence, the shortcoming that the current matching cannot be satisfied can be entirely avoided.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A current distributor for distributing the current evenly through a plurality of rows of light-emitting diodes, each respectively being coupled between a supply pin and a first current pin, said first current pin being coupled to said current distributor, said current distributor being coupled to a total current pin, said current distributor comprising:

a first resistor having a first end and a second end, said first end being coupled to said supply pin; a second resistor having a third end and a fourth end, said third end being coupled to said supply pin;

a plurality of first clamp circuitries being coupled to said second end of said first resistor and said first current pin;

a comparator having first and second input terminals and an output terminal, said first input terminal being coupled to said second end of said first resistor, said second input terminal being coupled to said fourth end of said second resistor;

a second clamp circuitry coupled between said fourth end of said second resistor and said total current pin; and a plurality of first transistors having a first terminal, a second terminal and a gate, said first terminal being coupled to said first current pin, said gate being coupled to said output terminal of said comparator, and said second terminal being coupled to said total current pin.

2. The current distributor according to claim 1, wherein each of said plurality of first clamp circuitries includes a forward diode.

3. The current distributor according to claim 1, wherein said first terminal of each of said first transistor is a drain, and said second terminal of each of said first transistor is a source.

4. The current distributor according to claim 1, wherein said comparator is an error amplifier.

5. The current distributor according to claim 1, wherein said second clamp circuitry includes a forward diode.

* * * * *